US005183475A

United States Patent [19]

Cardis et al.

[11] Patent Number: 5,183,475

[45] Date of Patent: Feb. 2, 1993

[54] FUEL COMPOSITIONS CONTAINING REACTION PRODUCTS OF AROMATIC TRIAZOLES AND FATTY ACIDS SALT AS ANTIWEAR ADDITIVES

[75] Inventors: Angeline B. Cardis, Florence, N.J.; Carl E. Shanholtz, Lawrenceville, both of N.J.

[73] Assignee: Mobil Oil Corporation, Fairfax, Va.

[21] Appl. No.: 434,944

[22] Filed: Nov. 9, 1989

[51] Int. Cl.[5] ..... C10L 1/22

[52] U.S. Cl. ..... 44/343

[58] Field of Search ..... 44/73, 63, 64, 66, 343

[56] References Cited

U.S. PATENT DOCUMENTS

| | | | |
|---|---|---|---|
| 3,444,170 | 5/1969 | Norman | 44/63 |
| 3,791,803 | 2/1974 | Andress, Jr. et al. | 44/343 |
| 3,843,337 | 10/1974 | Korpics | 44/63 |
| 4,060,491 | 11/1977 | Bridger et al. | 252/50 |
| 4,148,605 | 4/1979 | Andress, Jr. | 44/63 |
| 4,212,754 | 7/1980 | Chibnik | 252/49.7 |
| 4,227,889 | 10/1980 | Perilstein | 44/56 |
| 4,248,182 | 2/1981 | Malec | 123/1 |
| 4,282,007 | 8/1981 | Sung | 44/53 |
| 4,321,166 | 3/1982 | McGrady | 252/542 |
| 4,344,771 | 8/1982 | Bonazza et al. | 44/63 |
| 4,519,928 | 5/1985 | Braid | 252/50 |
| 4,803,004 | 2/1989 | Andress et al. | 252/51.5 A |
| 4,855,074 | 8/1989 | Papay et al. | 44/63 |

FOREIGN PATENT DOCUMENTS

| | | | |
|---|---|---|---|
| 2265088 | 4/1976 | Fed. Rep. of Germany | 44/63 |

*Primary Examiner*—Margaret Medley

*Attorney, Agent, or Firm*—Alexander J. McKillop; Charles J. Speciale; Jessica M. Sinnott

[57] ABSTRACT

A fuel composition contains an antiwear additive comprising the reaction product of a fatty acid salt comprising oleic acid, stearic acid, tall oil acid and dimer acid having 10 to 40 carbon atoms and an aromatic triazole such as tolyltriazole and method of making the same.

15 Claims, No Drawings

FUEL COMPOSITIONS CONTAINING REACTION PRODUCTS OF AROMATIC TRIAZOLES AND FATTY ACIDS SALT AS ANTIWEAR ADDITIVES

FIELD OF THE INVENTION

This invention relates to fuel compositions. More specifically it is concerned with fuel compositions containing the reaction products of aromatic triazoles and fatty acids which are useful as antiwear additives in distillate fuels such as diesel fuels and jet fuels.

BACKGROUND OF THE INVENTION

Engines, namely reciprocating internal combustion engines and jet engines, are susceptible to wear in areas of limited lubrication between contacting metal surfaces. Illustratively, in internal combustion engines it is believed that the upward motion of the piston causes wear in the region of the upper cylinder walls. Although lubricants prevent cylinder wear on the downward stroke, during the upward stroke the reduced amount of lubricant on the cylinder wall tends to increase the wear as the piston advances towards the top of its stroke. The fuel which is in contact with the contacting metal surfaces can, however, influence metal wear.

The use of fatty acids as antiwear additives in fuel compositions has been described; for example in U.S. Pat. No. 4,248,182 of Malec, which discloses the use of aliphatic monocarboxylic acids containing 8 to 20 carbon atoms as antiwear additives for fuels and U.S. Pat. No. 4,227,889 to Perilstein which discloses dimerized unsaturated fatty acids as antiwear additives for fuels.

Triazoles and their derivatives have been described as additives in lubricants and fuels; for example, U.S. Pat. No. 4,519,928 to Braid discloses N-t-alkylated benzotriazoles as antioxidant and anticorrosion additives in lubricants, U.S. Pat. No. 4,060,491 to Bridger et al. discloses 5-alkylbenzotriazoles wherein the alkyl group contains from 4 to about 16 carbon atoms as an antiwear additive in lubricants, and U.S. Pat. No. 4,212,754 to Chibnik discloses Werner coordinated complexes prepared with a benzotriazoles which may be used as antiwear additives in liquid hydrocarbon fuels.

It is believed that none of the prior art patents disclose fuel compositions containing the reaction products of aromatic triazoles and fatty acids of the present invention.

SUMMARY OF THE INVENTION

It has now been found that hydrocarbon fuel compositions containing the reaction products of aromatic triazoles and fatty acids exhibit desirable antiwear characteristics.

DETAILED DESCRIPTION OF THE INVENTION

The fuel compositions of the present invention contain a reaction product of an aromatic triazole and a fatty acid in an amount which is sufficient to impart antiwear properties to liquid hydrocarbon fuel, diesel fuel and oxygenated fuels such as alcohols and ether compounds.

The fatty acid contains from about 10 to about 40 carbon atoms and can be saturated or unsaturated. Preferably, the fatty acid should contain no more than about 6 carbon-carbon double bonds. The fatty acid used can be a carboxylic acid, a dicarboxylic acid, a dimer acid;

that is, a fatty acid produced by dimerization of an unsaturated fatty acid, usually containing approximately 36 carbons, and any mixtures of the foregoing. Certain preferred mixtures of fatty acids are referred to in the art as tall oil acids and soya oil acids.

In general, the aromatic triazoles have the structural formula:

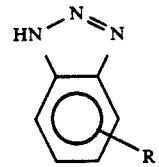

where R is a hydrogen, alkyl, aryl, arylalkyl or alkylaryl group of 1 to about 12 carbon atoms. A preferred aromatic triazole is tolyltriazole (wherein R is methyl).

The reaction products utilized in the present fuel compositions are formed by reacting the fatty acid with the aromatic triazole to form the fatty acid salt of the triazole. Accordingly, the fatty acid and the triazole will react in stoichiometric proportions to form the desired salt although the reaction may usually be carried out with the acid and the triazole present in proportions expressed as molar ratios of fatty acid to aromatic triazole of from 1:0.5 to about 1:1. The reaction will proceed at ambient pressure and at mildly elevated temperature, typically ranging from 5° C. to 260° C.; the preferred temperature range is 35° C. to 230° C. In general, the reactants are contacted for about 0.25 to about 12 hours with from about 0.5 to about 6 hours being preferred depending upon the reactants used, since the particular reaction times utilized depend on the temperature and the reactants employed. At higher temperatures the reaction time may be shorter than the time at a lower temperature for a given pair of reactants. A diluent or solvent may be used, normally an aromatic hydrocarbon solvent, with the preferred solvent being xylenes or a commercial mixture of xylenes.

A minor amount of the reaction product is blended with a major amount of the fuel: any amount of the reaction product which is effective for imparting the desired degree of wear reduction can be used. The additive is effectively employed in amounts from 0.01 to 5.0% and preferably from 0.05 to 1.0% of the total weight of the composition.

The fuels may be hydrocarbon fuels, oxygenates or mixtures of the two. The hydrocarbon fractions which may be used for the fuel compositions include distillate fuels which boil in the kerosene and gas oil range, usually about 330° to 1050° F. (165° to 565° C.). Typical middle distillate fuels of this kind include road diesel and other diesel fuels, typically with boiling ranges in the range of about 400° to 700° F. (about 205° to 370° C.) and jet fuels such as JP-4, Jet A and Kerosene.

The oxygenated fuels include methyl and ethyl alcohols and ethers. The fuels contemplated can also include blends of oxygenated fuels and hydrocarbon fractions.

The following examples illustrate the preparation of a reaction product which is blended with a fuel oil to make the composition of the present invention.

EXAMPLE 1

A 500 ml reactor equipped with a $N_2$ inlet, mechanical stirrer, thermometer and condenser was charged with 70.0 gm (0.247 mol) oleic acid, 33.0 gm (0.248 mol) tolyltriazole and 100 ml of xylenes as a solvent. The mixture was heated to reflux for 4 hours with a $N_2$ purge. The xylenes were evaporatively distilled at atmospheric pressure. A resulting brown oil was dried in a vacuum oven at 250–300 mmHg and 100° C. for 72 hours. The resulting brown oil slowly solidified over a period of several days.

EXAMPLE 2

A 250 ml reactor equipped with a $N_2$ inlet, mechanical stirrer, thermometer and condenser was charged with 70.0 gm (0.250 mol) dimer acid and 33.0 gm (0.248 mol) of tolyltriazole. The mixture was heated to 110° C. for 0.5 hours with a $N_2$ purge and was then allowed to come to ambient temperature for over 1 hour. The resulting amber oil slowly solidified over a period of several days.

EXAMPLE 3

A 250 ml reactor equipped with a $N_2$ inlet, mechanical stirrer, thermometer and condenser was charged with 70.0 gm (0.250 mol) of stearic acid and 33.0 gm (0.248 mol) of tolytriazole. The mixture was heated to 160° C. for 0.5 hours with a $N_2$ purge and was then allowed to come to ambient temperature over 1.5 hours resulting in a tan solid.

EXAMPLE 4

A 250 ml reactor equipped with a $N_2$ inlet, mechanical stirrer, thermometer and condenser was charged with 70.0 gm (0.248 mol) of tall oil acid and 33.0 gm (0.248 mol) of tolytriazole. The mixture was heated to 150° C. for 1.5 hours with a $N_2$ purge. A brown oil resulted.

The following data illustrate the improved antiwear characteristics of the present invention. The antiwear properties of the fuel composition were determined in the 4-Ball Wear Test. This test was conducted in a device comprising four steel balls, three of which were in contact with each other in one plane in a fixed triangular position in a reservoir containing the test sample. The fourth ball was above and in contact with the other three. The fourth ball was rotated while it was pressed against the other three balls while pressure was applied by weight and lever arms. The diameter of the scar on the other three lower balls was measured by means of a low power microscope and the average diameter measured in two directions on each of the three lower balls was taken as a measure of the antiwear characteristics of the fuel.

In the antiwear test data reported below in Table 1 the base stock comprised a diesel fuel containing 0.19 wt % of sulfur. The balls were immersed in the base stock containing the reaction products. The applied load was 10 kg and rotation was at 600 rpm for 30 minutes at 122° C. Tests were conducted with base fuel alone and with base fuel containing the reaction products. The lower the wear diameter, the more effective the composition as an antiwear agent. Table 1 shows the marked decrease wear scar diameter obtained with respect to moving steel-on-steel surfaces employing the Four-Ball Wear test.

TABLE 1

Four-Ball Wear Test Results on Fuel Composition Containing Reaction Product

| Additive in Base Stock (0.1 wt %) | Wear Scar Diameter (mm) |
|---|---|
| None | 0.538 |
| Example 1 | 0.269 |
| Example 2 | 0.244 |
| Example 3 | 0.325 |
| Example 4 | 0.267 |

We claim:

1. A liquid fuel composition comprising a major proportion of a fuel selected from the group comprising alcohol and ether oxygenate fuels, diesel fuel and liquid hydrocarbon fuel and a fatty acid salt reaction product made by reacting an aromatic triazole and a fatty acid selected from the group comprising oleic acid, stearic acid, tall oil acid, and dimer acid having 10 to 40 carbon atoms, in an antiwear additive amount ranging from 0.01 to 5.0 wt. % by weight of the composition.

2. The composition of claim 1 wherein the aromatic triazole is tolyltriazole.

3. The composition of claim 1 wherein the fuel is a liquid hydrocarbon fraction.

4. The composition of claim 1 wherein the fuel is an alcohol or ether.

5. The composition of claim 1 wherein the fuel is a distillate fuel.

6. The composition of claim 1 wherein the fuel is a diesel fuel or a jet fuel.

7. The composition of claim 1 wherein the fuel is a liquid hydrocarbon fraction containing alcohol fuels, or ether fuels or a mixture thereof.

8. A method of making a fuel composition comprising combining a liquid hydrocarbon fuel or liquid oxygenated fuel or mixtures thereof and about 0.01 and 5.0 weight % of a fatty acid salt obtained by reacting an aromatic triazole and a fatty acid selected from the group comprising oleic acid, stearic acid, tall oil acid, and dimer acid having 10 to 40 carbon atoms.

9. The method of claim 8 in which the aromatic triazole is tolyltriazole.

10. A liquid fuel composition comprising a major proportion of a fuel selected from the group comprising alcohol and ether oxygenate fuels, diesel fuel and liquid hydrocarbon fuel and a fatty acid salt reaction product made by reacting tolyltriazole and a dimer fatty acid having 10 to 40 carbon atoms of mono- and dicarboxylic acids or mixtures thereof, in an antiwear additive amount ranging from 0.01 to 5.0 wt. % by weight of the composition.

11. The composition of claim 10 in which the fuel is a liquid hydrocarbon fraction.

12. The composition of claim 10 in which the fuel is an alcohol or ether.

13. The composition of claim 10 in which the fuel is a distillate fuel.

14. The composition of claim 13 in which the fuel is a diesel fuel or a jet fuel.

15. The composition of claim 10 in which the fuel is liquid hydrocarbon fraction containing alcohol fuels or ether fuels or a mixture thereof.

* * * * *